US006430384B2

(12) United States Patent
Hama et al.

(10) Patent No.: US 6,430,384 B2
(45) Date of Patent: Aug. 6, 2002

(54) DEVELOPER-CARRYING MEMBER HAVING EXPOSED SURFACE CONTAINING GRAPHITE OR MOLYBDENUM DISULFIDE PARTICLES

(75) Inventors: Masayuki Hama; Kazushige Nishiyama, both of Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/745,478

(22) Filed: Dec. 26, 2000

(30) Foreign Application Priority Data

Dec. 28, 1999 (JP) ..... 11-375668

(51) Int. Cl.[7] ..... G03G 15/06; G03G 15/08

(52) U.S. Cl. ..... 399/276; 29/895.32

(58) Field of Search ..... 399/276, 286; 430/120, 122; 29/30, 37, 48, 895, 895.32

(56) References Cited

U.S. PATENT DOCUMENTS 4,564,285 A * 1/1986 Yasuda et al. ..... 399/274
4,989,044 A 1/1991 Nihimura et al. ..... 355/251
5,274,426 A * 12/1993 Goseki et al. ..... 399/276
5,547,724 A * 8/1996 Kuribayashi ..... 428/35.8
5,851,719 A * 12/1998 Takei et al. ..... 399/276 X
6,341,420 B1 * 1/2002 Swartz et al. ..... 29/895.32

FOREIGN PATENT DOCUMENTS

| | | |
|---|---|---|
| JP | 01-276174 | 11/1989 |
| JP | 3-64781 | * 3/1991 |
| JP | 8-305169 | * 11/1996 |
| JP | 9-106173 | * 4/1997 |

* cited by examiner

*Primary Examiner*—Joan Pendegrass
(74) *Attorney, Agent, or Firm*—Fitzpatrick, Cella, Harper & Scinto

(57) ABSTRACT

A developer-carrying member has a conductive substrate and a conductive resin coating layer provided on the surface of the conductive substrate. The conductive resin coating layer has a resin in which graphite particles or molybdenum disulfide particles stand dispersed, and the particles are uncovered to the surface of the conductive resin coating layer at a specific degree of uncovering. Also disclosed are a process for producing the developer-carrying member, a developing apparatus having the developer-carrying member, and an image-forming apparatus having the developing apparatus.

96 Claims, 5 Drawing Sheets

DEVELOPER-CARRYING MEMBER HAVING EXPOSED SURFACE CONTAINING GRAPHITE OR MOLYBDENUM DISULFIDE PARTICLES

BACKGROUND OF THE INVENTION

1. Field of the Invention

This invention relates to a developer-carrying member used in developing apparatus of an electrophotographic system, which constitutes image-forming apparatus such as copying machines and laser beam printers, and more particularly to a developer-carrying member having on its surface a conductive resin coating layer. It also relates to a process for producing such a developer-carrying member, a developing apparatus having the developer-carrying member, and an image-forming apparatus having such a developing apparatus.

2. Related Background Art

As a developing apparatus in which electrostatic latent images formed on the surface of a photosensitive drum serving as an image bearing member are developed using a magnetic toner of a one-component developer, conventionally known is an apparatus in which triboelectric charges with a polarity reverse to that of electric charges of an electrostatic latent image on the photosensitive drum and that of development reference potential are imparted to magnetic toner particles by the friction between magnetic toner particles themselves and mutual friction between a developer sleeve as a developer-carrying member and the magnetic toner particles, the magnetic toner thus charged is very thinly coated on the developer sleeve and is carried and transported to a developing zone where the developer sleeve faces the photosensitive drum, and in that developing zone the magnetic toner is caused to fly and adhere to the electrostatic latent image on the photosensitive drum surface by the action of a magnetic field generated by a magnet disposed stationarily inside the developer sleeve, to make development to render the electrostatic latent image visible as a toner image.

As the developer-carrying member used in such an apparatus, commonly in wide used are members obtained by forming a metal such as aluminum, nickel, corrosion-resistant steel (stainless steel) or an alloy or compound thereof into a cylindrical shape and treating its surface by, e.g., electrolysis, blasting or filing so as to have a stated surface roughness. In particular, aluminum alloys are inexpensive compared with other metals and moreover have so high a thermal conductivity as to little cause any thermal deformation, and also may hardly cause developer's charge-up. Accordingly, developer-carrying members making use of aluminum alloys have become prevalent.

However, aluminum sleeves making use of such aluminum alloys have a low hardness, and hence they have a problem that the sleeve surface so treated by blasting as to have a stated surface roughness may easily wear at the initial stage of service when left as it is. Hence, as disclosed in Japanese Patent Application Laid-Open No. 1-276174, it is attempted to use a cylinder formed of an aluminum alloy and coated with a resin on its surface. In such an example, the sleeve surface is coated with a phenolic resin having a good mechanical strength, to form a conductive resin layer in which conductive particles such as carbon or graphite particles stand dispersed in the resin, thereby improving its surface hardness while maintaining conductivity necessary for the developer-carrying member. In such a case, the sleeve surface is coated with the resin by spraying in a thickness of about 10 to 20 $\mu$m, and hence can fundamentally be flat though the unevenness the underlying aluminum alloy surface has is slightly followed. However, its surface is in such a state that fine particles such as carbon or graphite particles have been embedded in the phenolic resin, and hence the cross-sectional shape of the roughness stands relatively close to the above blasted metal surface.

When a positively chargeable toner is triboelectrically charged and when a coating film is formed using the phenolic resin as stated above, the resin has originally such a charge polarity that it charges the toner negatively. Hence, it is hard for the toner to be positively charged. Accordingly, in usual instances, a positive-charge-providing molecule such as a quaternary ammonium salt is added to the resin so that the positively chargeable toner (developer) can be provided with positive charges. However, a sufficient charge quantity can not yet be attained, and there has been a problem that, when the developer-carrying member having a conductive resin layer is used, images formed have a low image density. This tendency is remarkable especially at the initial stage of the driving of image-forming apparatus.

SUMMARY OF THE INVENTION

An object of the present invention is to provide a developer-carrying member that can solve the above problem, a developer-carrying member production process that can produce such a developer-carrying member, a developing apparatus having the developer-carrying member, and an image-forming apparatus having such a developing apparatus.

Another object of the present invention is to provide a developer-carrying member that can be improved in its ability to impart electric charges triboelectrically to positively chargeable developers, and provide a developer-carrying member production process that can produce such a developer-carrying member with ease, a developing apparatus having the developer-carrying member, and an image-forming apparatus having such a developing apparatus.

Still another object of the present invention is to provide a developer-carrying member by which positively chargeable one-component developers can stably triboelectrically be charged and can keep image density from changing not only at the initial stage of service after the developer-carrying member has been produced but also at a stage where its conductive resin coating layer has worn as a result of long-term service, and provide a developer-carrying member production process that can produce such a developer-carrying member with ease, a developing apparatus having the developer-carrying member, and an image-forming apparatus having such a developing apparatus.

A further object of the present invention is to provide a developer-carrying member production process by which particles of graphite or molybdenum disulfide having good positive-charge-providing properties can effectively be laid bare or uncovered to the surface of the developer-carrying member in order to obtain a developer-carrying member that enables triboelectric charging of positively chargeable one-component developers sufficiently and without changes, and to prevent initial-stage image density from decreasing.

To achieve the above objects, the present invention provides a developer-carrying member comprising a conductive substrate and a conductive resin coating layer provided on the surface of the conductive substrate, wherein;

the conductive resin coating layer comprises a resin in which graphite particles stand dispersed, and the graphite particles are uncovered to the surface of the conductive resin coating layer at a degree of uncovering of 50% or more.

The present invention also provides a developer-carrying member comprising a conductive substrate and a conductive resin coating layer provided on the surface of the conductive substrate, wherein;

the conductive resin coating layer comprises a resin in which molybdenum disulfide particles stand dispersed, and the molybdenum disulfide particles are uncovered to the surface of the conductive resin coating layer at a degree of uncovering of 30% or more.

The present invention still also provides a process for producing a developer-carrying member, comprising the steps of:

primary treatment to form on the surface of a conductive substrate a conductive resin coating layer comprising a resin in which graphite particles stand dispersed; and secondary treatment to remove a surface portion of the conductive resin coating layer to uncover the graphite particles to the surface of the conductive resin coating layer at a degree of uncovering of 50% or more.

The present invention further provides a process for producing a developer-carrying member, comprising the steps of:

primary treatment to form on the surface of a conductive substrate a conductive resin coating layer comprising a resin in which molybdenum disulfide particles stand dispersed; and secondary treatment to remove a surface portion of the conductive resin coating layer to uncover the molybdenum disulfide particles to the surface of the conductive resin coating layer at a degree of uncovering of 30% or more.

The present invention still further provides a developing apparatus comprising:

a positively chargeable one-component developer for developing an electrostatic latent image formed on an image-bearing member; and a developer-carrying member for carrying thereon the positively chargeable one-component developer;

the developer-carrying member comprising a conductive substrate and a conductive resin coating layer provided on the surface of the conductive substrate, wherein;

the conductive resin coating layer comprises a resin in which graphite particles stand dispersed, and the graphite particles are uncovered to the surface of the conductive resin coating layer at a degree of uncovering of 50% or more.

The present invention still further provides a developing apparatus comprising:

a positively chargeable one-component developer for developing an electrostatic latent image formed on an image-bearing member; and a developer-carrying member for carrying thereon the positively chargeable one-component developer;

the developer-carrying member comprising a conductive substrate and a conductive resin coating layer provided on the surface of the conductive substrate, wherein;

the conductive resin coating layer comprises a resin in which molybdenum disulfide particles stand dispersed, and the molybdenum disulfide particles are uncovered to the surface of the conductive resin coating layer at a degree of uncovering of 30% or more.

The present invention still further provides an image-forming apparatus comprising a developing apparatus having:

a positively chargeable one-component developer for developing an electrostatic latent image formed on an image-bearing member; and a developer-carrying member for carrying thereon the positively chargeable one-component developer;

the developer-carrying member comprising a conductive substrate and a conductive resin coating layer provided on the surface of the conductive substrate, wherein;

the conductive resin coating layer comprises a resin in which graphite particles stand dispersed, and the graphite particles are uncovered to the surface of the conductive resin coating layer at a degree of uncovering of 50% or more.

The present invention still further provides an image-forming apparatus comprising a developing apparatus having:

a positively chargeable one-component developer for developing an electrostatic latent image formed on an image-bearing member; and a developer-carrying member for carrying thereon the positively chargeable one-component developer;

the developer-carrying member comprising a conductive substrate and a conductive resin coating layer provided on the surface of the conductive substrate, wherein;

the conductive resin coating layer comprises a resin in which molybdenum disulfide particles stand dispersed, and the molybdenum disulfide particles are uncovered to the surface of the conductive resin coating layer at a degree of uncovering of 30% or more.

DETAILED DESCRIPTION OF THE PREFERRED EMBODIMENTS

Figure 1:
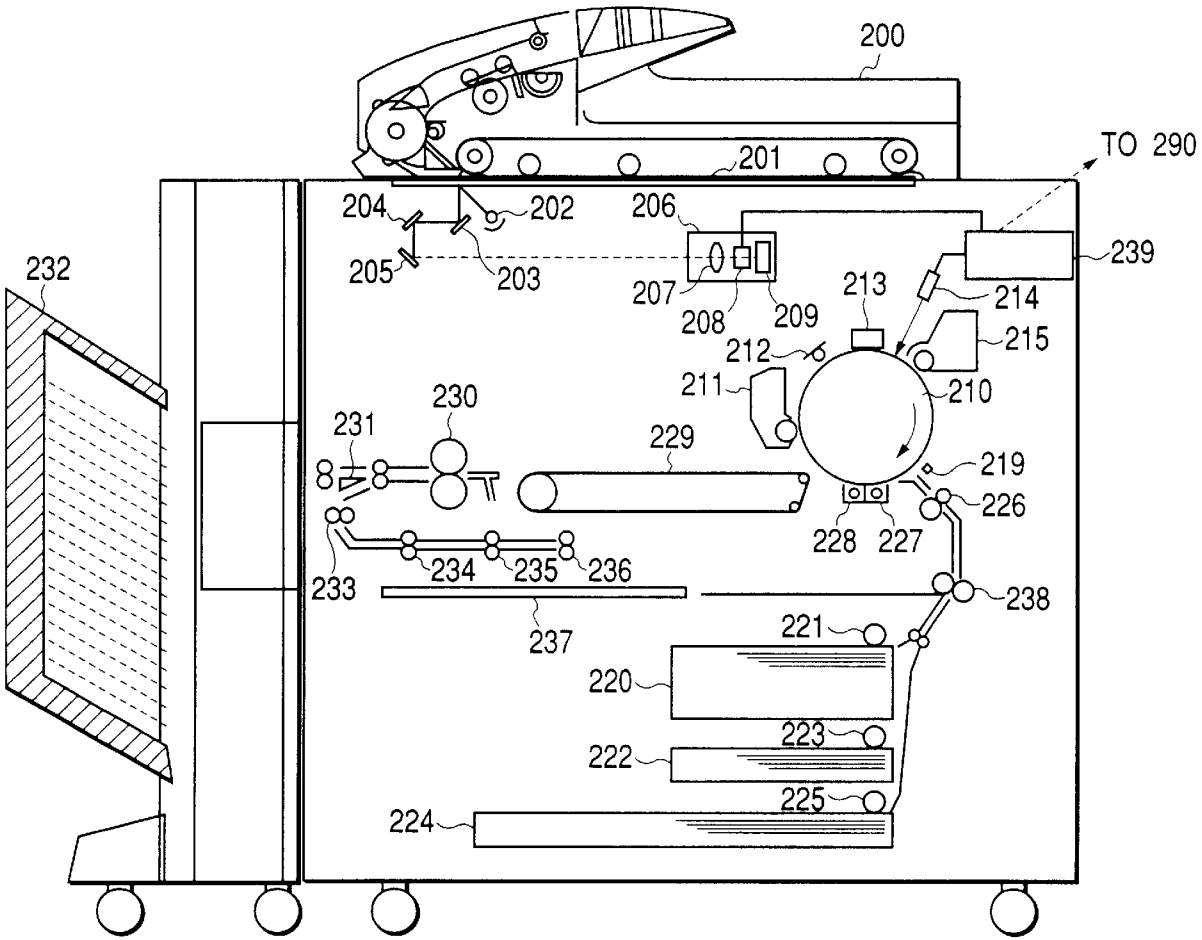
FIG. 1 is a schematic cross-sectional illustration of an example of an image-forming apparatus (copying machine).

The present invention will be described below in detail by giving preferred embodiments of the present invention.

To solve the problem in the prior art, involved in the developer-carrying member having a conductive resin layer on its surface, the present inventors made extensive studies on the constitution of conductive resin layers of developer-carrying members and on their outermost surfaces. As the result, they have accomplished the present invention as described below.

In developer-carrying members on the sleeve surface of which a conductive resin layer has been formed as stated previously, particles whose triboelectric charging polarity to a positively chargeable toner is positive, such as graphite particles and molybdenum disulfide particles, may further be added to the conductive resin layer, whereby a higher-level charge quantity can be achieved. In order to bring out the effect of such particles having positive-charge-providing properties, it is necessary for such particles to be brought into direct contact with the toner, i.e., for the substance having positive-charge-providing properties to be sufficiently uncovered to the developer-carrying member surface.

However, according to studies made by the present inventors, immediately after the developer-carrying member surface has been coated with a conductive resin, its surface is in such a state that the whole outermost surface is covered with only a resin containing a quaternary ammonium salt which is a positive-charge-providing molecule, and the particles such as graphite particles or molybdenum disulfide particles, having a large particle diameter, are positioned in the interior of the resin coating layer and do not stand bare or uncovered directly to the surface. Hence, in the state of the developer-carrying member surface immediately after the formation of the conductive resin layer, the toner can not sufficiently triboelectrically be charged, and hence images having a sufficient image density can not be obtained when images are formed using such a developer-carrying member.

On the other hand, image density becomes higher as the resin at the outermost surface of the conductive resin layer formed on the developer-carrying member is abraded as a result of friction during running and the area in which the particles such as graphite particles or molybdenum disulfide particles are uncovered becomes larger. Thus, it follows that always stable image density can not be attained when images are formed, because the image density lowers for the above reason at the initial stage where the developer-carrying member has begun to be used.

The present inventors repeated extensive studies on the constitution of the developer-carrying member so that images having always stable image density can be formed from the initial stage where the developer-carrying member has begun to be used. As the result, they have discovered that a developer-carrying member may be used which has a conductive resin coating layer containing graphite particles or molybdenum disulfide particles and having been so treated that the graphite particles are uncovered to the coating layer surface at a degree of uncovering of 50% or more or the molybdenum disulfide particles at a degree of uncovering of 30% or more; this can improve the developer-carrying member's ability to impart electric charges triboelectrically to positively chargeable developers, and images having stable image density can be formed because the graphite particles or molybdenum disulfide particles whose triboelectric charging polarity to the positively chargeable toner is positive are sufficiently uncovered to the surface of the developer-carrying member even at the initial stage where the developer-carrying member has begun to be used after the production of the developer-carrying member. Thus, they have accomplished the present invention.

Figure 3:
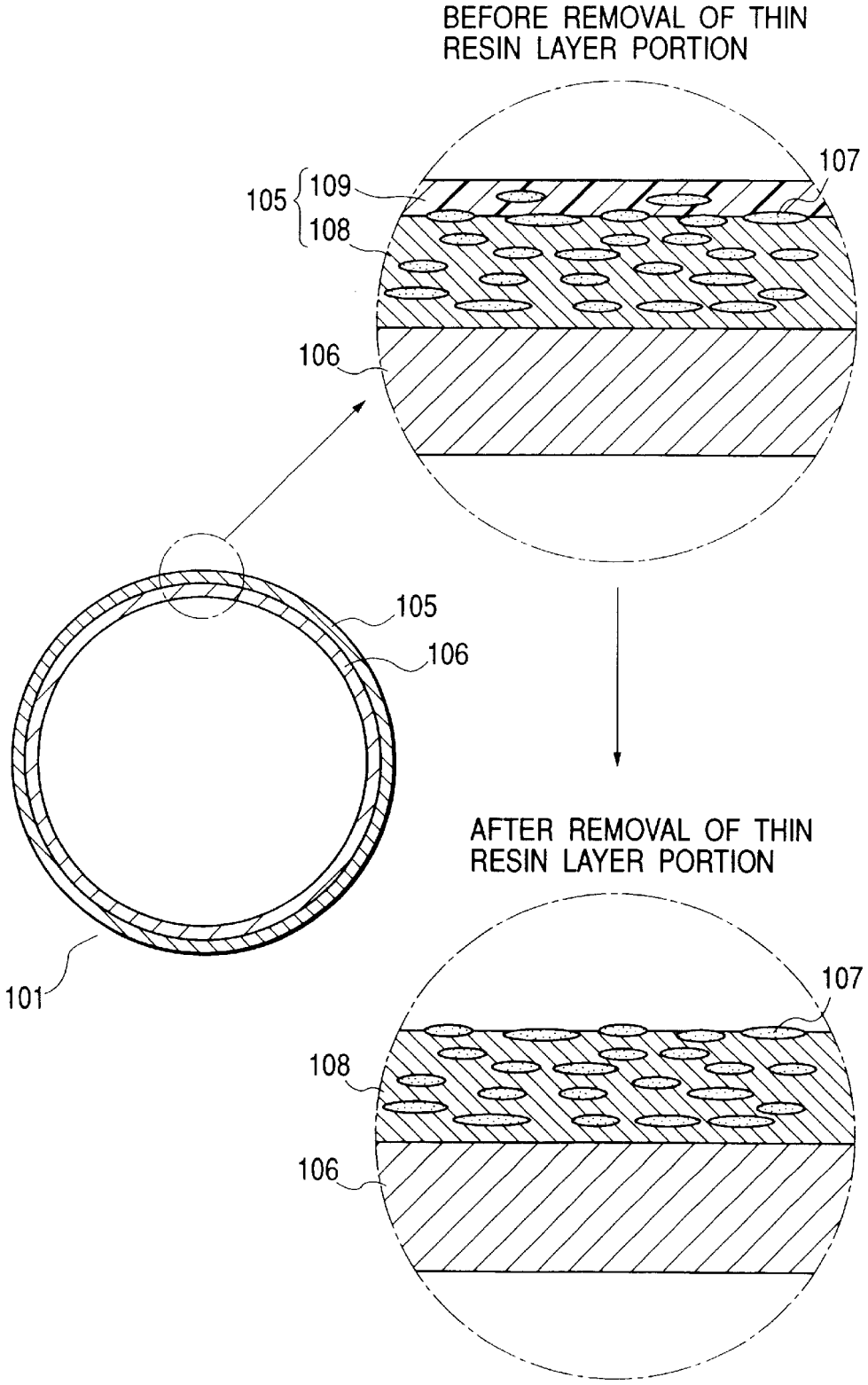
FIG. 3 is a schematic cross-sectional illustration of the developer-carrying member of the present invention and a resin coating layer formed at its surface.

Stated specifically, as shown in FIG. 3, a developer-carrying member 101 has a conductive substrate, developer-carrying member basis pipe 106, and a conductive resin coating layer 105 formed on the surface of this developer-carrying member basis pipe 106. The conductive resin coating layer 105 comprises a resin 108 in which graphite particles or molybdenum disulfide particles 107 stand dispersed. When the developer-carrying member having this conductive resin coating layer is produced, first the conductive resin coating layer 105 containing graphite particles or molybdenum disulfide particles dispersedly is formed on the surface of the developer-carrying member basis pipe, followed by secondary treatment to remove a thin resin layer portion 109 lying at the outermost surface of the coating layer (i.e., remove a surface portion of the resin coating layer), where the developer-carrying member surface is so treated that (i) the graphite particles are uncovered to the surface of the conductive resin coating layer at a degree of uncovering of 50% or more, and preferably from 50 to 98%, or (ii) the molybdenum disulfide particles at a degree of uncovering of 30% or more, and preferably from 30 to 95%.

Figure 4:
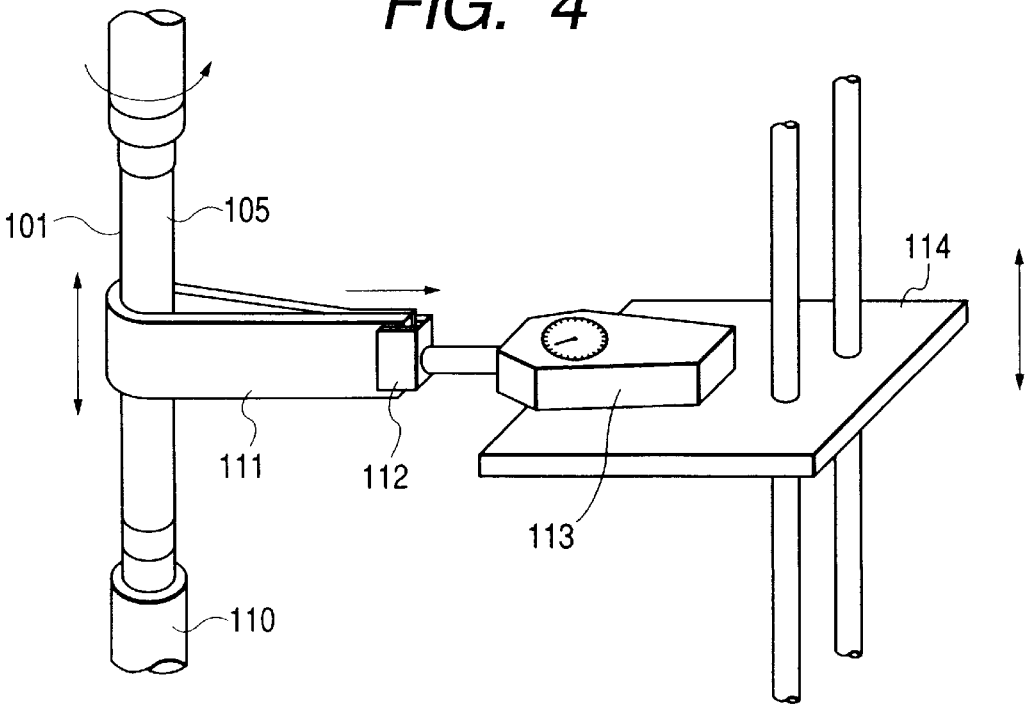
FIG. 4 is a perspective illustration of a surface-polishing apparatus used to treat the surface of the developer-carrying member.

After the conductive resin coating layer has been formed on the surface of the developer-carrying member basis pipe, the treatment to remove the resin lying at the outermost surface of the coating layer is carried out until the quantity in which the graphite particles or molybdenum disulfide particles present in the interior of the resin coating layer are uncovered to the developer-carrying member surface becomes saturated to come to be a constant value. Here, in order for the graphite particles to be uncovered at a degree of uncovering of 50% or more, or the molybdenum disulfide particles at a degree of uncovering of 30% or more, as will be described later in Examples, polishing is repeated regulating its polishing strength (pressure), using a polishing apparatus as shown in FIG. 4, so as to remove the outermost layer resin which covers the graphite particles or molybdenum disulfide particles and also to extend the graphite particles or molybdenum disulfide particles over the surface of the resin coating layer. Such polishing by means of the polishing apparatus as shown in FIG. 4 may preferably be carried out at least 15 times.

The developer-carrying member thus produced may be saturated in the area in which the graphite particles or molybdenum disulfide particles are uncovered to the developer-carrying member surface, whereby the graphite particles or molybdenum disulfide particles can be uncovered at a sufficient degree of uncovering at the initial stage of service after production. Hence, a developer-carrying member can be obtained which may cause no change in image density of images formed from the initial stage of service up to long-term running, even when a new developer-carrying member having been produced is used.

In the present invention, the conductive resin coating layer of the developer-carrying member may be formed using a resin composition prepared by incorporating, together with the graphite particles or molybdenum disulfide particles, a charge control agent and conductive fine particles in a film-forming polymeric material (resin material). As the film-forming resin material, those having good mechanical properties as exemplified by phenolic resin and polyamide resin may preferably be used. As the conductive fine particles, conductive particles such as conductive fine amorphous carbon particles may preferably be incorporated, which have good electrical conductivity, can be added to the polymeric material to impart conductivity thereto and also can provide some desired degree of conductivity by controlling the quantity for their addition.

In the present invention, the conductive resin coating layer containing the conductive particles may preferably be conductive in order to prevent the positively chargeable one-component developer from sticking to the developer-carrying member because of charge-up and to prevent any faulty charging from being caused by the charge-up of the positively chargeable one-component developer when triboelectric charges are imparted from the surface of the developer-carrying member to the positively chargeable one-component developer. Accordingly, in the present invention, the conductive fine particles may preferably be incorporated in the conductive resin coating layer to make the resin coating layer have a volume resistivity of $10^3$ Ω·cm or below, more preferably from $10^{-2}$ to $10^3$ Ω·cm, and still more preferably from $10^{-2}$ to $10^2$ Ω·cm. More specifically, if the resin coating layer on the developer-carrying member has a volume resistivity above $10^3$ Ω·m, faulty charging to the developer tends to occur. If the conductive resin coating layer has a too low volume resistivity, the charging to the positively chargeable one-component developer may be so excessively small as to cause short triboelectricity to tend to cause a decrease in image density.

In the present invention, the conductive fine particles incorporated in the conductive resin coating layer may preferably be in a content of from 1 to 120 parts by weight, and more preferably from 2 to 50 parts by weight, based on 100 parts by weight of the resin.

If the conductive fine particles are in a content less than 1 part by weight, it may be difficult to make the conductive resin coating layer well conductive. If the particles are in a content more than 120 parts by weight, the conductive resin coating layer itself may have a low strength and also the charge-providing properties to the developer tend to lower.

In the present invention, the volume resistivity of the conductive resin coating layer is measured in the following way.

A conductive resin coating layer of 7 to 20 μm thick is formed on a PET (polyethylene terephthalate) film of 100 μm thick is formed, and its volume resistivity is measured with a voltage-drop type digital ohmmeter (manufactured by Kawaguchi Denki Seisakusho) provided with an electrode having a four-terminal structure for use in the measurement of volume resistivity of conductive rubber and plastic, which accords with the ASTM standard (D-991-82) and Japan Rubber Manufacturers Association Standard SRIS (2301-1969). Incidentally, the measurement is made in an environment of 20 to 25° C. and 50 to 60% RH.

What is characteristic of the developer-carrying member of the present invention is that the graphite particles or molybdenum disulfide particles are dispersedly contained in the conductive resin coating layer and the developer-carrying member surface is so treated that (i) the graphite particles are uncovered to the surface of the conductive resin coating layer at a degree of uncovering of 50% or more, and preferably from 50 to 98%, or (ii) the molybdenum disulfide particles at a degree of uncovering of 30% or more, and preferably from 30 to 95%. More specifically, in the developer-carrying member of the present invention, the graphite particles or molybdenum disulfide particles contained in the resin coating layer formed at the surface of the developer-carrying member have a triboelectric charging polarity which is positive to the positively chargeable toner and also act as a solid lubricant. Hence, when images are formed, these inorganic particles come into contact with the toner on the developer-carrying member and improve the fluidity of toner on the developer-carrying member to enlarge the charge quantity to the positively chargeable toner and prevents electric charges from accumulating on the developer-carrying member. As the result, the toner can be charged in a sufficient and appropriate quantity.

On the other hand, according to the studies made by the present invention, the effect attributable to the addition of these graphite particles or molybdenum disulfide particles can not well be brought out and a high image density can not be achieved in some cases when, as in the case of conventional developer-carrying members, (i) the graphite particles are uncovered to the surface of the conductive resin coating layer at a degree of uncovering of less than 50% or (ii) the molybdenum disulfide particles at a degree of uncovering of less than 30%. Also, this tendency is remarkable at the initial stage where the developer-carrying member has begun to be used after its production, and further the image density tends to become higher with running service, tending to cause a difference in image density between the initial stage and a stage after running on many sheets. This is because the graphite particles or molybdenum disulfide particles contained in the conductive resin coating layer formed at the developer-carrying member surface stand not well uncovered to the coating layer surface immediately after the developer-carrying member has been produced, but these inorganic particles become well uncovered to the surface with running service, so that the above phenomenon occurs. Accordingly, when the developer-carrying member is produced, the surface of the developer-carrying member may be treated so that the graphite particles or molybdenum disulfide particles present at the surface are uncovered in a sufficient area. Thus, the effect attributable to the addition of the graphite particles or molybdenum disulfide particles in the resin coating layer can be brought out even at the initial stage where the developer-carrying member has begun to be used after its production, and hence always stable image density can be achieved. The present inventors have discovered the foregoing, and have accomplished the present invention.

They have also prepared a false developer-carrying member having a high degree of uncovering of from 80 to 100% by rub-coating graphite particles or molybdenum disulfide particles directly on the developer-carrying member surface by means of waste, and used it to form images. As a result, the image density has slightly decreased when the degree of uncovering become 98% or more in the case of graphite particles and when it become 95% or more in the case of molybdenum disulfide particles. Thus, when the degree of uncovering of the graphite particles or molybdenum disulfide particles in the conductive resin coating layer is too high, the developer-carrying member surface has so high a slipperiness as to lower developer transport performance to tend to cause a decrease in image density. Accordingly, the upper limit of the degree of uncovering may preferably be the value set out above.

What is herein meant by treating so as to be saturated in the uncovering area is that the graphite particles or molybdenum disulfide particles contained dispersedly in the conductive resin coating layer stand alike both at the surface and in the interior of the layer and the state of the outermost surface of the developer-carrying member is maintained alike without changes also when the developer-carrying member surface comes to have worn.

Further studies made by the present inventors have revealed that, since in the developer-carrying member of the present invention the graphite particles or molybdenum disulfide particles are used as inorganic particles incorporated in the conductive resin coating layer, the degree of uncovering of these particles can be calculated from the glossiness of the developer-carrying member surface as described later, and hence the outermost thin resin layer portion can be removed until the degree of uncovering of graphite particles or that of molybdenum disulfide particles comes to be 50% or more or 30% or more, respectively, making sure of the uncovering area by measuring the glossiness. As the result, it becomes possible to readily obtain the developer-carrying member constituted as described above, having a good developing performance such that the state in which the graphite particles or molybdenum disulfide particles having a triboelectric charging polarity which is positive to the positively chargeable toner are uncovered to the surface does not change even at the initial stage where the developer-carrying member has begun to be used after its production and also when it comes to have worn.

In the present invention, the graphite particles or molybdenum disulfide particles contained dispersedly in the conductive resin coating layer may preferably be in an amount of from 2 to 120 parts by weight, and more preferably from 4 to 60 parts by weight, based on 100 parts by weight of the resin.

If the graphite particles or molybdenum disulfide particles are in a content less than 2 parts by weight, any improvement in charge-providing properties which is attributable to their addition can not be seen. If they are in a content more than 120 parts by weight, they may poorly be dispersed in the resin to tend to make the conductive resin coating layer itself have a low strength.

In the present invention, the conductive resin coating layer may preferably have a layer thickness of 25 $\mu$m or smaller, and more preferably from 4 to 20 $\mu$m. This is preferable because the resin coating layer can be formed in a uniform layer thickness.

In the present invention, in the conductive resin coating layer, a quaternary ammonium salt compound represented by the following general formula may respectively be used as a charge control agent.

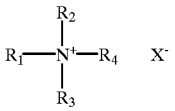

wherein $R_1$, $R_2$, $R_3$ and $R_4$ may be the same or different and each represent an alkyl group which may have a substituent, an aryl group which may have a substituent, or an aralkyl group; and $X^-$ represents an anion of an acid.

Specific exemplary compounds of the quaternary ammonium salt compound represented by the above general formula are shown below.

Exemplary Compound 1

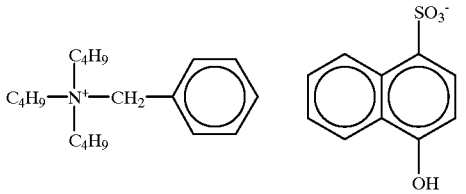

Exemplary Compound 2

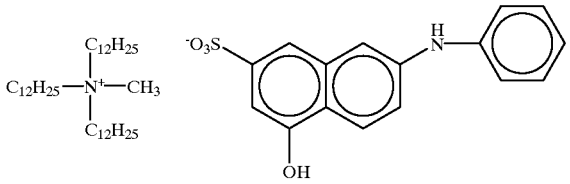

-continued

Exemplary Compound 3

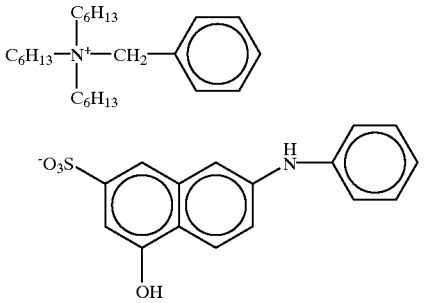

Exemplary Compound 4

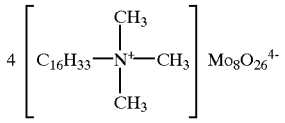

Exemplary Compound 5

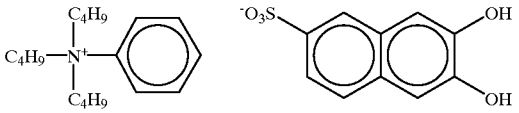

Exemplary Compound 6

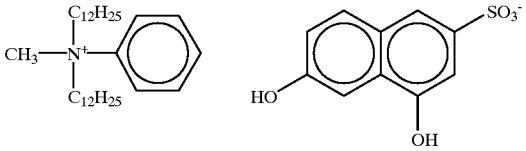

Exemplary Compound 7

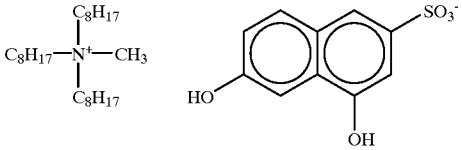

Exemplary Compound 8

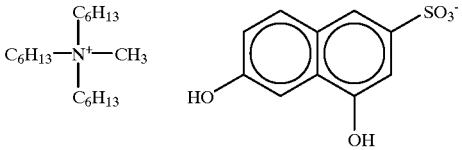

The developer-carrying member of the present invention carries and transports a positively chargeable one-component developer formed on its surface in thin layer. This positively chargeable one-component developer is described below.

A positively chargeable toner the positively chargeable developer has is a fine powder comprised of a colored resin composition, which is chiefly composed of a binder resin for toner, a release agent, a charge control agent and a colorant as materials, and is usually produced by, e.g., melt-kneading these materials, cooling the kneaded product to solidify, and thereafter pulverizing the resultant kneaded product, further optionally followed by classification for adjustment to the desired particle size distribution.

As the binder resin for toner which is used in the positively chargeable toner used in the present invention, any of commonly known resins may be used.

The positively chargeable toner used in the present invention contains the colorant. In the case of a non-magnetic toner, it contains a known dye or pigment. In the case of a magnetic toner, it contains a known magnetic material as the colorant.

As the positively chargeable one-component developer used in the present invention, an inorganic fine powder such as silica, alumina or titania powder may optionally externally be added to the positively chargeable toner for the purpose of improving its fluidity. Such an inorganic fine powder may preferably be a hydrophobic inorganic fine powder having a positive triboelectric chargeability, which has been made hydrophobic by treatment with a known hydrophobic-treating agent containing nitrogen-containing compound.

An image-forming apparatus having a developing apparatus making use of the developer-carrying member of the present invention is described below with reference to the accompanying drawings. Here, the image-forming apparatus is described taking the case of a copying machine. The present invention is by no means limited to the apparatus according to this embodiment, and includes, e.g., image-forming apparatus such as laser beam printers and facsimile machines.

FIG. 1 cross-sectionally illustrates the construction of the image-forming apparatus (copying machine) of the present invention.

In FIG. 1, reference numeral 200 denotes an automatic original feeder (hereinafter "DF"). A plurality of originals loaded therein are sheet by sheet fed by the feeder, and the originals are sequentially set on an original stand with the former's surface or back in contact with the latter. Its specific construction is known in the art, and detailed description thereon is omitted here. A plurality of originals to be read by the machine is placed on the DF 200. The originals placed on the DF 200 are sheet by sheet fed as mentioned above, and are sequentially set on an original stand 201.

Reference numeral 202 denotes an original illumination lamp constituted of a halogen lamp, which applies light to an original placed on the original stand 201. Reference numerals 203, 204 and 205 denote scanning mirrors, which are held in an optical scanning unit (not shown), and lead the light reflected from the original to a CCD unit 206 during its reciprocating motion. The CCD unit 206 is constituted of an imaging lens 207 which forms into an image in a CCD (charge-coupled device) the light reflected from the original, an imaging device 208 constituted of this CCD, a CCD driver 209 which drives the imaging device 208, and so forth.

Image output signals from the imaging device 208 are converted into, e.g., 8-bit digital data, and thereafter inputted to a controller section 239. Reference numeral 210 denotes a photosensitive drum, from which electric charges are eliminated by a pre-exposure lamp 212 to make preparation for image formation. Here, an amorphous-silicon drum is used as the photosensitive drum 210. The amorphous-silicon drum comprises a cylindrical conductive substrate provided thereon with an amorphous-silicon film, and is characterized by having, e.g., a high photosensitivity, a high running performance and a long service life. Reference numeral 213 denotes a charging assembly, which primarily uniformly charges the photosensitive drum 210 to, e.g., +300 to +600 V. An exposure means 214 is constituted of, e.g., a semiconductor laser, and exposes the photosensitive drum 210 in accordance with image data processed in the controller section 239 which performs image processing and controls the whole apparatus, so that a digital electrostatic latent image having, e.g., a light-area potential of +300 to +600 V and a dark-area potential of +10 to +100 V is formed on the photosensitive drum 210.

Reference numeral 215 denotes the developing apparatus, in which a black developer is held and by means of which the electrostatic latent image formed on the photosensitive drum 210 is developed. Reference numeral 219 denotes a transfer pre-charging assembly, which applies a high voltage before the toner image formed by development on the photosensitive drum 210 is transferred to transfer paper. Reference numerals 220, 222 and 224 denote paper feed units, from which the transfer paper is fed into the main apparatus by the drive of each paper feed roller 221, 223 or 225, once stopped at a position where a resisting roller 226 is provided, and then again fed in begin-to-write timing with the image formed on the photosensitive drum 210.

Reference numeral 227 denotes a transfer charging assembly, which transfers the toner image developed on the photosensitive drum 210, to the transfer paper being fed. A separation charging assembly 228 separates from the photosensitive drum 210 the transfer paper to which the transfer has been completed. Incidentally, the toner remaining on the photosensitive drum 210 without being transferred is collected by means of a cleaner 211. Also, reference numeral 229 denotes a transport belt, which transports to a fixing assembly 230 the transfer paper to which the transfer process has been completed, where the toner image is fixed by, e.g., heat. Then, reference numeral 231 denotes a flapper, which switches transport paths for the transfer paper to which the fixing process has been completed, and so controls the paper as to either be delivered outside as paper on which the copying has been completed, or be put to the direction where an intermediate tray 237 is disposed.

Reference numerals 233 to 236 denote feed rollers, which feed the transfer paper on which the fixing process has once been completed, to the intermediate tray 237 in reverse (for multiple copying) or in non-reverse (double-side copying). Also, reference numeral 238 denotes a re-feed roller, which again feeds the transfer paper placed on the intermediate tray 237, to the position where the resisting roller 226 is provided.

Reference numeral 232 denotes a stapling sorter, which sorts and staples sheets of paper on which copies have been taken. Incidentally, the controller section 239 has a microcomputer, an image processing unit and so forth, and performs the above image-forming action in accordance with instructions from an operation panel (not shown).

Figure 2:
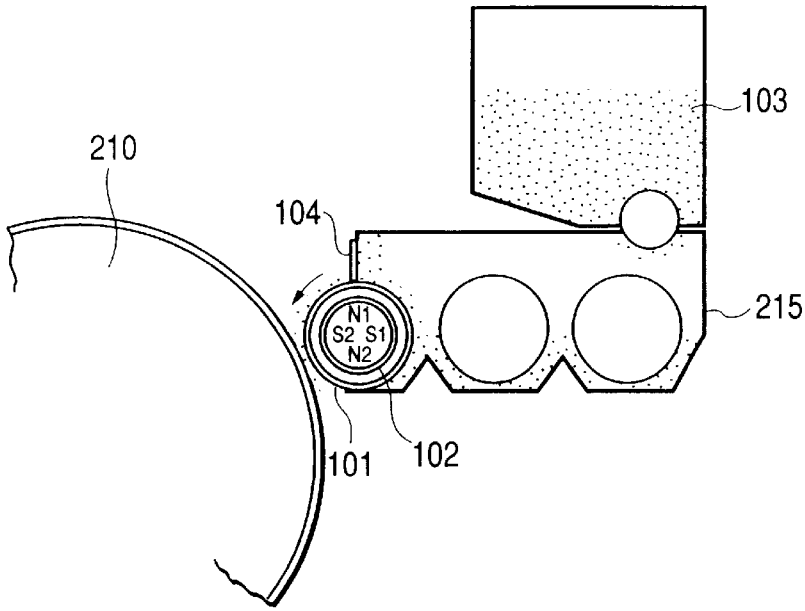
FIG. 2 is a schematic cross-sectional illustration of an example of a developing apparatus constituting the image-forming apparatus shown in FIG. 1.

The developing apparatus will be detailed below subsequently. As shown in FIG. 2, the developing apparatus 215 used in the image-forming apparatus shown in FIG. 1 holds therein a positively chargeable one-component developer, in this example, a magnetic toner 103 which is a positively chargeable one-component magnetic developer, and has a developer-carrying member 101 in the developing apparatus 215 at its opening which faces the photosensitive drum 210. Inside the developer-carrying member 101, a multi-polar permanent magnet 102 is unrotatably disposed. The developer-carrying member 101 is rotated in the direction of an arrow, carrying thereon the toner 103 by the action of the magnet 102. At the surface of this developer-carrying member 101, a conductive resin coating layer 105 which is the conductive resin coating layer described previously is formed in a thickness within the range of from about 10 $\mu$m to about 20 μm. The developing apparatus further has a doctor blade 104 as a developer regulation member. The doctor blade 104 regulates in a stated thickness the toner layer carried on the developer-carrying member 101. A gap between the doctor blade 104 and the developer-carrying member 101 is set within the range of from about 50 μm to about 500 μm.

The present developing apparatus is constructed as described above, and the developer-carrying member 101 is rotated in the direction of the arrow upon actuation, where, as a result of friction between particles themselves of the toner 103 or friction between the surface of the developer-carrying member 101 and the toner 103, triboelectric charges having a polarity reverse to that of electrostatic-image electric charges on the photosensitive drum 210 with respect to the reference potential of development are imparted to the toner 103, and the toner is coated on the surface of the developer-carrying member 101. The toner layer thus formed by coating on the developer-carrying member surface is further so regulated by the doctor blade 104 as to become a toner thin layer which is uniform and also has a layer thickness within the range of from about 30 μm to about 300 μm; the doctor blade 104 facing the magnetic pole N1 of the magnet 102. Then, as the developer-carrying member 101 is rotated, the toner thin layer is transported to a developing zone between the photosensitive drum 210 and the developer-carrying member 101, where it is used for the development of the electrostatic latent image formed on the surface of the photosensitive drum 210. The toner layer has a thickness smaller than the gap between the photosensitive drum 210 and the developer-carrying member 101 at the developing zone, and what is called non-contact development is performed. In the developing zone, a development bias voltage having, e.g., a DC bias of from +200 to +400 V and an AC bias with Vpp (peak-to-peak voltage) of from 800 to 1,800 V and frequency of from 1,800 to 3,000 Hz is applied to the developer-carrying member 101 so that an AC electric field is formed across the developer-carrying member 101 and the photosensitive drum 210 surface and the positively chargeable toner 103 on the developer-carrying member can be made to fly in the direction of the photosensitive drum 210 to participate in development.

As described above, according to the present invention, the developer-carrying member can be improved in its ability to impart electric charges triboelectrically to positively chargeable one-component developers, and the particles whose triboelectric charging polarity to positively chargeable toners is positive are uncovered to the surface of the developer-carrying member so sufficiently that the image density can be prevented from changing.

EXAMPLES

The present invention will be described below in greater detail by giving Examples of the present invention and Comparative Examples.

Examples 1 to 3 & Comparative Examples 1 to 3

Developer-carrying members No. 1 to No. 6 used in the above image-forming apparatus (copying machine) shown in FIG. 1 were produced in the following way.

First, materials shown below were mixed, and the mixture formed was subjected to dispersion treatment for 3 hours by means of a sand mill, using zirconia particles of 2 mm diameter as a filler. Thereafter, the zirconia particles were separated with a sieve. The mixture thus treated was regulated with IPA (isopropyl alcohol) to have a solid content of 30% to obtain a resin composition comprising a phenolic resin in which a quaternary ammonium salt compound positively chargeable to iron powder was added.

| | (by weight) |
|---|---|
| Fine carbon particles | 20 parts |
| Graphite particles | 60 parts |
| Phenolic resin produced in the presence of ammonia as a catalyst (solid content: 50%) | 500 parts |
| Quaternary ammonium salt compound represented by the following formula (1) | 50 parts |
| Methanol | 150 parts |

(1)

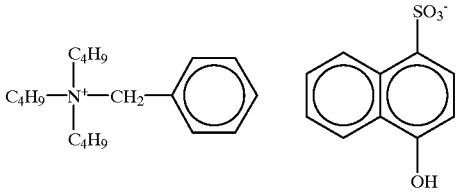

The resin composition thus obtained was in the form of a coating material, and had composition of C(carbon)/G (graphite)/B(phenolic resin)/P(quaternary ammonium salt compound)=0.2/0.6/2.5/0.5. Next, this resin composition was coated on an aluminum cylinder of 32 mm diameter by spraying to form a coating film of 20 μm thick, followed by heating and curing at 150° C. for 30 minutes by means of a hot-air dryer to produce a developer-carrying member having at its surface a conductive resin coating layer. The developer-carrying member thus obtained was designated as a developer-carrying member No. 1.

The volume resistivity of the resin composition used in the above was measured in the following way. The resin composition in the form of a coating material was coated on an insulating sheet by means of a bar coater, followed by heat-drying. Thereafter, this sheet was cut into a regular form, and its volume resistivity was measured with a low-resistivity meter LORESTER (manufactured by Mitsubishi Chemical Corporation). As the result, the resin composition used in the present Example had a volume resistivity of 1.5×10 Ω·cm.

The surface of the developer-carrying member No. 1 having the resin coating layer formed at its surface as described above was further polished with adjustment of polishing strength (pressure), by means of a polishing apparatus shown in FIG. 4. The polishing apparatus shown in FIG. 4 can readily uncover the crystalline graphite contained in the surface resin coating layer 105 of the developer-carrying member 101. As shown in FIG. 4, the developer-carrying member 101 is set upright and, in the state the both ends positioned at its top and bottom are fixed on a main shaft 110, rotated via the main shaft 110 by means of a drive unit (not shown). Then, a belt-like polishing material lapping tape 111 fixed on a holder 112 is put around the developer-carrying member 101 along its periphery, and its surface is polished under application of a tensile load to the developer-carrying member 101 being rotated. During the polishing, the tensile load is measured with a load-measuring instrument 113 connected to the holder 112 to adjust the polishing pressure. As shown in FIG. 4, the load-measuring instrument 113 is provided on a feed stand 114 which is movable in the lengthwise direction of the developer-carrying member 101 (vertically) together with the lapping tape 111.

The developer-carrying member No. 1 obtained as described above was set on the polishing apparatus shown in FIG. 4, and the feed stand 114 was one way moved once from one end of the main shaft 110 to the other end thereof to obtain a developer-carrying member polished once, which was designated as a developer-carrying member No. 2.

Developer-carrying members No. 1 likewise obtained as described above were each further set on the polishing apparatus shown in FIG. 4, and the feed stand 114 was vertically reciprocated four times to obtain a developer-carrying member polished eight times, which was designated as a developer-carrying member No. 3; reciprocated eight times to obtain a developer-carrying member polished sixteen times, which was designated as a developer-carrying member No. 4; reciprocated twelve times to obtain a developer-carrying member polished twenty-four times, which was designated as a developer-carrying member No. 5; and reciprocated sixteen times to obtain a developer-carrying member polished thirty-two times, which was designated as a developer-carrying member No. 6.

On the developer-carrying members No. 1 to No. 6 thus obtained, glossiness and degree of uncovering of graphite particles were measured in the following way. Results obtained were as shown in Table 1. As the result of measurement, the developer-carrying members No. 4, No. 5 and No. 6 were confirmed to have been so treated that the degree of uncovering of graphite particles to the conductive resin coating layer surface was 50% or more, and were regarded as developer-carrying members of Examples 1, 2 and 3, respectively. Also, the developer-carrying members No. 1, No. 2 and No. 3, which were still at a degree of uncovering of less than 50%, were regarded as Comparative Examples 1, 2 and 3, respectively.

Glossiness

Glossiness of each surface of the developer-carrying members No. 1 to No. 6 was measured with a glossiness meter TC108DP/A (manufactured by Tokyo Denshoku K.K.).

Degree of Graphite Particle Uncovering

The developer-carrying member surface per unit surface area was observed from above, and the proportion of graphite particle area in which the graphite particles were uncovered to the surface was viewed as a plane and was expressed by percentage. The uncovering area was measured with a laser microscope for a given area on each developer-carrying member, and determined by calculation.

Evaluation

Using the developer-carrying members No. 1 to No. 6 of Examples and Comparative Examples, evaluation was further made on the ability to impart electric charges triboelectrically to the toner, by measuring the quantity of triboelectricity of toner in the manner shown below. Also, using the above developer-carrying members No. 1 to No. 6 each as the developer-carrying member in the developing apparatus of the image-forming apparatus shown in FIG. 1, continuous image reproduction on 50,000 sheet was tested under development conditions show below, to make evaluation on image density of images formed at the initial stage (1,000 sheets) and images formed after continuous running (50,000 sheets). The results of these were as shown in Table 2 below.

As the development conditions, development was performed under the following conditions: The surface of the drum type amorphous-silicon photosensitive member was primarily charged to +400 V, and the surface of the amorphous-silicon photosensitive member thus primarily charged was exposed to semiconductor laser beams to form an electrostatic latent image having a light-area potential of +400 V and a dark-area potential of +50. The gap between the developer-carrying member surface and the amorphous-silicon photosensitive member surface at the developing zone was 200 μm. The developer layer formed on the developer-carrying member was 100 μm thick. A development bias voltage having a DC bias of +280 and an AC bias with Vpp of 1,000 V and frequency of 2,700 Hz was applied to the developer-carrying member. Under such conditions, reverse development was performed using a positively chargeable one-component magnetic developer obtained by pulverization as described below.

The developer was a positively chargeable one-component magnetic developer produced by externally adding as a positively chargeable external additive 0.9% by weight of colloidal silica coupling-treated with trimethoxylsilyl-γ-propylbenzylamine, to a positively chargeable toner having a weight-average particle diameter of 9 μm which was obtained by melt-kneading the following constituent materials, followed by pulverization and classification.

| | (by weight) |
|---|---|
| Styrene-acrylic resin (Tg: 56° C.) | 100 parts |
| Magnetite | 80 parts |
| Positive charge control agent (Copy Blue) | 2 parts |
| Low-molecular weight polypropylene | 4 parts |

Quantity of Triboelectricity of Toner (Q/M)

Using a measuring container having a cylindrical filter paper, a suction mouthpiece made of a metal after the shape of the periphery of the developer-carrying member was attached thereto. Suction pressure was so controlled that the developer layer on the developer-carrying member surface standing immediately after image formation was able to be uniformly sucked in a proper quantity, and the developer was sucked. Electric charges Q of the developer sucked here were measured with a 616 digital electrometer (manufactured by Keithley Co.), and their mass (weight), represented by M, was calculated by Q/M (μC/g). Measurement was made after image reproduction on 1,000 sheets and after image reproduction on 50,000 sheets.

Image Density

The developer-carrying members No. 1 to No. 6 were each set in the image-forming apparatus constructed as described above, and images were continuously reproduced on 50,000 sheets under environmental conditions of normal temperature/normal humidity of 25° C./50% RH and high temperature/high humidity of 30° C./80% RH. Image density of solid black images obtained respectively after image reproduction on 1,000 sheets and after image reproduction on 50,000 sheets was measured with a Macbeth densitometer to obtain the values as shown in Table 2.

Image Quality

Character images thus reproduced were magnified about 30 times, and images were evaluated according to the following evaluation criteria:

A: Lines are sharp, and spots around line images are little seen.

B: Lines are relatively sharp, but spots around line images are a little seen.

C: Spots around line images are greatly seen, and lines look blurred.

As can be seen from the results shown in Table 1 on the developer-carrying members No. 1 to No. 6 (Examples and Comparative Examples), the glossiness of the developer-carrying member surface increases with an increase in the number of times of polishing with the lapping tape. As shown in Table 1, it was confirmable that this glossiness and the degree of uncovering of graphite particles were in constant proportionality. Accordingly, measuring the glossiness of the developer-carrying member surface can readily determine the degree of uncovering of graphite particles to the developer-carrying member surface. It was also confirmable that, with an increase in the degree of uncovering of graphite particles to the developer-carrying member surface, i.e., with an increase in opportunities of contact of graphite particles with the toner, the quantity of triboelectricity of the toner and the image density increased, and came to be substantially constant values when the degree of uncovering was about 55%, and moreover that, as shown in Table 2, sufficient quantity of triboelectricity of the toner and image density were attained at that value.

Figure 5:
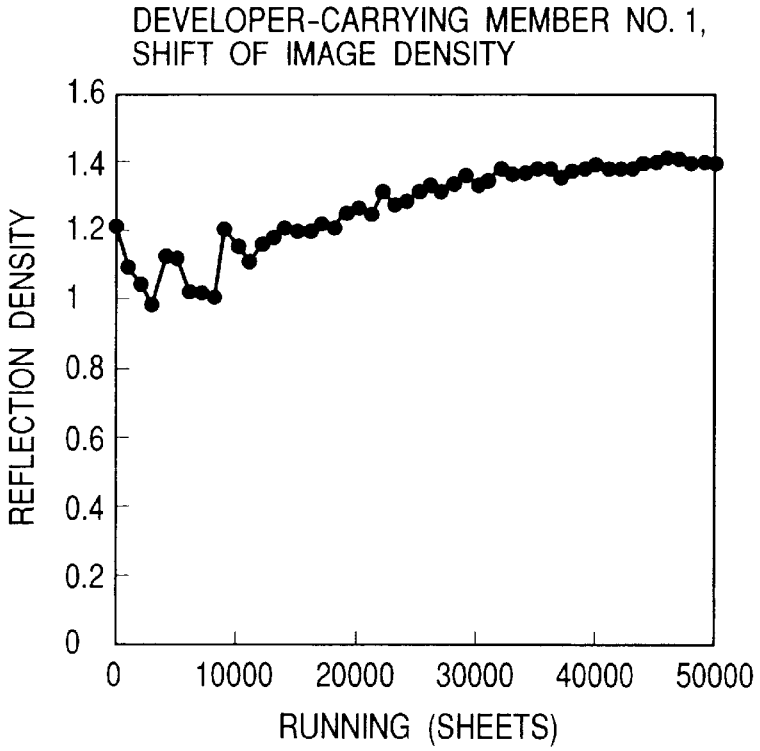
FIG. 5 is a graph showing how image density shifts in a developer-carrying member No. 1 in Comparative Example 1.
Figure 6:
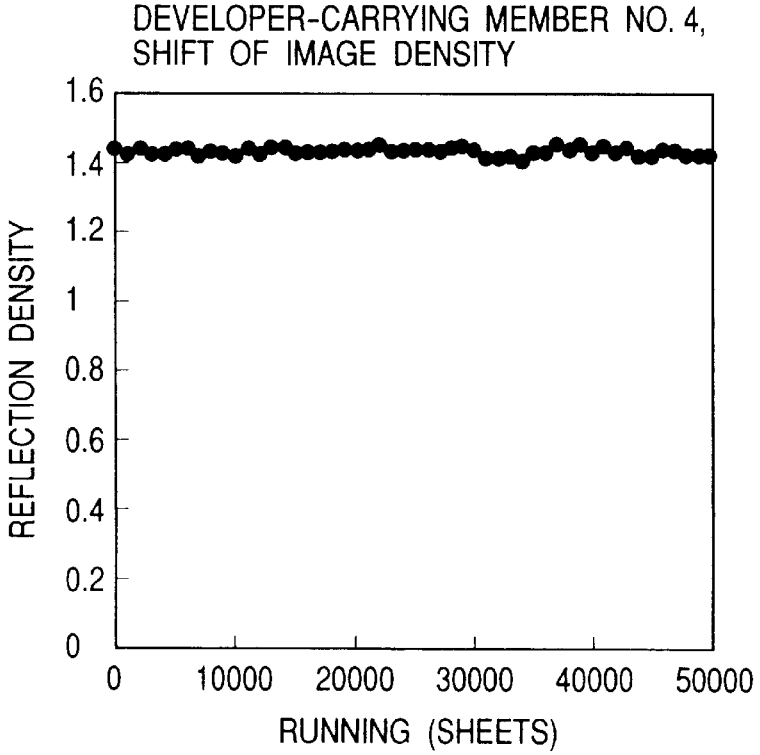
FIG. 6 is a graph showing how image density shifts in a developer-carrying member No. 4 in Example 1.

A running test of image reproduction on 50,000 sheets was further made on an actual machine, using the developer-carrying members No. 4 to No. 6 (Examples 1 to 3) having been polished sixteen times or more and the developer-carrying member No. 1 (Comparative Example 1) having not been polished. Shown in FIG. 6 are changes in image density in the case when the developer-carrying member No. 4 is used as an example. In the case of the developer-carrying members No. 4 to No. 6 (Examples 1 to 3) having been polished sixteen times or more, any great changes in image density were not seen compared with the developer-carrying member No. 1 of Comparative Example 1 having not been polished by means of the surface-polishing apparatus shown in FIG. 5.

From the foregoing results, it has been found that the compositional proportion of the resin may be so determined that the degree of uncovering comes finally to be a constant value of 50% or more when the surface is polished on to uncover the graphite particles present in the resin coating layer, and the surface may be polished until the degree of uncovering comes to be 50% or more, whereby a developer-carrying member can be provided which can triboelectrically charge the toner in a sufficient quantity and through which images with a stable density can be obtained.

Examples 4 and 5 & Comparative Examples 4 to 6

In these examples, molybdenum disulfide particles were used as the inorganic particles whose triboelectric charging polarity to positively chargeable toners is positive. Materials shown below were mixed, and the mixture formed was subjected to dispersion treatment for 3 hours by means of a sand mill, using zirconia particles of 2 mm diameter as a filler. Thereafter, the zirconia particles were separated with a sieve, and the mixture thus treated was regulated with IPA to have a solid content of 35% to obtain a resin composition.

| | (by weight) |
|---|---|
| Fine carbon particles | 20 parts |
| Molybdenum disulfide particles | 40 parts |

-continued

| | (by weight) |
|---|---|
| Phenolic resin produced in the presence of hexamethylenetetramine as a catalyst (solid content: 50%) | 500 parts |
| Quaternary ammonium salt compound represented by the above formula (1) | 50 parts |
| Methanol | 150 parts |

The resin composition thus obtained was in the form of a coating material, and had composition of C(carbon)/$MoS_2$ (molybdenum disulfide)/B(phenolic resin)/P(quaternary ammonium salt compound)=0.2/0.5/2.5/0.5. The volume resistivity of the coating material type resin composition was also measured in the same manner as that described previously, to find that it showed a value of 9.9×10 Ω·cm.

Next, this resin composition was coated on an aluminum cylinder of 32 mm diameter by spraying to form a coating film of 20 μm thick, followed by heating and curing at 150° C. for 30 minutes by means of a hot-air dryer to produce a developer-carrying member No. 7 having at its surface a conductive resin coating layer. Using the developer-carrying member No. 7 thus obtained, the surface was further polished by the polishing appratus in the same manner as that for the developer-carrying member No. 1 to obtain developer-carrying members having been polished once, eight times, sixteen times and twenty-four times as developer-carrying members No. 8 to No. 11, respectively.

On the developer-carrying members No. 7 to No. 11 thus obtained, glossiness and degree of uncovering of molybdenum disulfide particles were measured in the same manner as in the case of the developer-carrying member No. 1 to obtain the results shown in Table 3. As the result of measurement, the developer-carrying members No. 10 and No. 11 were confirmed to have been so treated that the degree of uncovering of molybdenum disulfide particles to the conductive resin coating layer surface was 30% or more, and were regarded as developer-carrying members of Examples 4 and 5, respectively. Also, the developer-carrying members No. 7, No. 8 and No. 9, which were not still saturated, were regarded as Comparative Examples 4, 5 and 6, respectively.

On these developer-carrying members No. 7 to No. 11, too, the quantity of triboelectricity Q/M and image density were evaluated in the same manner as in the case of the previous developer-carrying members No. 1 to No. 6 to obtain the results shown in Table 4. Also, FIG. 7 shows the results of a 50,000-sheet image reproduction running test made on the developer-carrying member No. 10.

Figure 7:
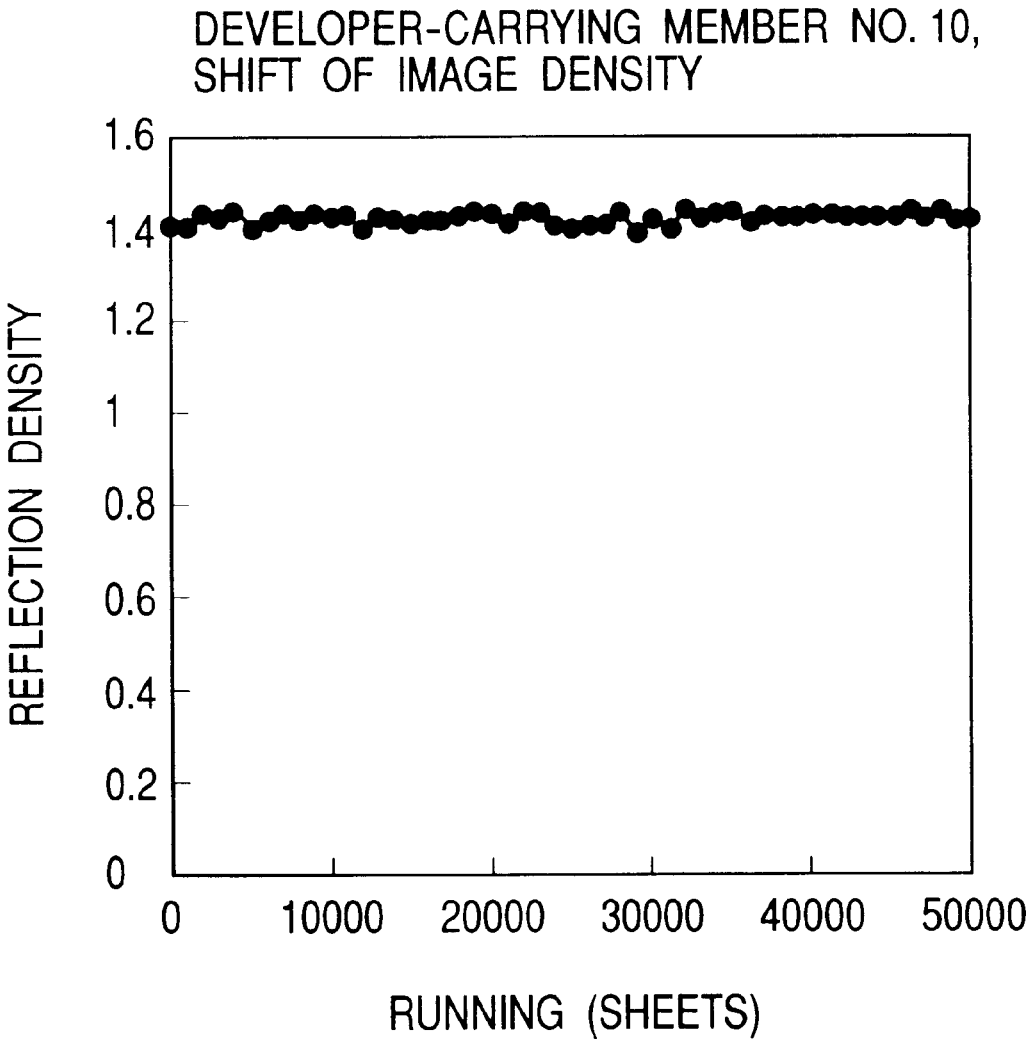
FIG. 7 is a graph showing how image density shifts in a developer-carrying member No. 10 in Example 4.

As can be seen from the results shown in Tables 3 and 4 and FIG. 7 on the developer-carrying members No. 7 to No. 11, the glossiness of the developer-carrying member surface increases with an increase in the number of times of polishing with the lapping tape. It was shown that this glossiness and the degree of uncovering of molybdenum disulfide particles were in constant proportionality. Thus, it was found that measuring the glossiness of the developer-carrying member surface can readily determine the degree of uncovering of molybdenum disulfide particles to the developer-carrying member surface also when the molybdenum disulfide particles are incorporated. It was also confirmable that, with an increase in the degree of uncovering of molybdenum disulfide particles to the developer-carrying member surface, i.e., with an increase in opportunities of contact of molybdenum disulfide particles with the toner, the quantity of triboelectricity of the toner and the image density increased, and came to be substantially constant values when the degree of uncovering of molybdenum disulfide particles exceeded about 30%, and moreover that sufficient quantity of triboelectricity and image density were attained at that value.

As shown in the above Examples 1 to 5 and Comparative Examples 1 to 6, when the developer-carrying member is used at the surface of which the resin coating layer has been formed which contains the inorganic particles whose triboelectric charging polarity to positively chargeable toners is positive, the graphite particles or molybdenum disulfide particles, the graphite particles or molybdenum disulfide particles may be made to stand uncovered to the developer-carrying member surface, whereby the positively chargeable toner can triboelectrically be charged in a large quantity.

TABLE 1-continued

Production Conditions and Physical Properties of Developer-carrying Members

| | Developer-carrying member No. | Graphite particle uncovering treatment | Glossiness | Degree of uncovering (%) |
|---|---|---|---|---|
| Example: | | | | |
| 1 | 4 | Lapping-polished sixteen times | 9.2 | 54.0 |
| 2 | 5 | Lapping-polished twenty-four times | 9.3 | 55.0 |
| 3 | 6 | Lapping-polished thirty-two times | 9.3 | 55.0 |

TABLE 2

Surface Properties and Evaluation Results of Developer-carrying Members

| | Normal temperature/normal humidity | | | | | | High temperature/high humidity | | | | | |
|---|---|---|---|---|---|---|---|---|---|---|---|---|
| | Initial stage, after 1,000 sheets | | | After running, after 50,000 sheets | | | Initial stage, after 1,000 sheets | | | After running, after 50,000 sheets | | |
| | Q/M | Image density | Image quality | Q/M | Image density | Image quality | Q/M | Image density | Image quality | Q/M | Image density | Image quality |
| Comparative Example: | | | | | | | | | | | | |
| 1 | 3.9 | 0.76 | C | 6.0 | 1.39 | B | 3.1 | 0.60 | C | 4.9 | 1.29 | B |
| 2 | 4.6 | 1.12 | B | 6.7 | 1.42 | A | 4.1 | 0.89 | B | 5.1 | 1.31 | B |
| 3 | 5.9 | 1.38 | B | 6.9 | 1.43 | A | 4.8 | 1.22 | B | 5.4 | 1.33 | A |
| Example: | | | | | | | | | | | | |
| 1 | 7.0 | 1.44 | A | 7.2 | 1.44 | A | 5.5 | 1.35 | A | 5.5 | 1.33 | A |
| 2 | 7.4 | 1.45 | A | 7.2 | 1.44 | A | 5.6 | 1.35 | A | 5.5 | 1.33 | A |
| 3 | 7.3 | 1.45 | A | 7.2 | 1.44 | A | 5.6 | 1.36 | A | 5.5 | 1.33 | A |

Also, it has been found that the degree of uncovering can be calculated from the surface glossiness of the developer-carrying member. Thus, it has been found that the outermost surface resin may be removed until the degree of uncovering of graphite particles comes to be 50% or more or the degree of uncovering of molybdenum disulfide particles comes to be 30% or more while making sure of the uncovering area, whereby the particles whose triboelectric charging polarity to positively chargeable toners is positive can sufficiently be uncovered to the surface even after preparation and at the initial stage of the use, so that a superior developer-carrying member can be obtained which has always constant and satisfactory developability.

TABLE 1

Production Conditions and Physical Properties of Developer-carrying Members

| | Developer-carrying member No. | Graphite particle uncovering treatment | Glossiness | Degree of uncovering (%) |
|---|---|---|---|---|
| Comparative Example: | | | | |
| 1 | 1 | None | 0.6 | 3.0 |
| 2 | 2 | Lapping-polished once | 1.6 | 8.0 |
| 3 | 3 | Lapping-polished eight times | 6.8 | 21.0 |

TABLE 3

Production Conditions and Physical Properties of Developer-carrying Members

| | Developer-carrying member No. | Molybdenum disulfide particle uncovering treatment | Glossiness | Degree of uncovering (%) |
|---|---|---|---|---|
| Comparative Example: | | | | |
| 4 | 7 | None | 0.3 | 2 |
| 5 | 8 | Lapping-polished once | 0.7 | 6 |
| 6 | 9 | Lapping-polished eight times | 1.8 | 15 |
| Example: | | | | |
| 4 | 10 | Lapping-polished sixteen times | 3.8 | 32 |
| 5 | 11 | Lapping-polished twenty-four times | 4.2 | 35 |

TABLE 4

| Surface Properties and Evaluation Results of Developer-carrying Members | | | | | | | | | | | | |
|---|---|---|---|---|---|---|---|---|---|---|---|---|
| | Normal temperature/normal humidity | | | | | | High temperature/high humidity | | | | | |
| | Initial stage, after 1,000 sheets | | | After running, after 50,000 sheets | | | Initial stage, after 1,000 sheets | | | After running, after 50,000 sheets | | |
| | Q/M | Image density | Image quality | Q/M | Image density | Image quality | Q/M | Image density | Image quality | Q/M | Image density | Image quality |
| Comparative Example: | | | | | | | | | | | | |
| 4 | 4.8 | 1.22 | C | 5.9 | 1.40 | B | 3.5 | 0.72 | C | 5.2 | 1.31 | B |
| 5 | 5.3 | 1.31 | B | 7.0 | 1.42 | A | 4.4 | 1.10 | B | 5.4 | 1.33 | B |
| 6 | 6.6 | 1.38 | B | 7.1 | 1.42 | A | 4.9 | 1.25 | B | 5.5 | 1.34 | A |
| Example: | | | | | | | | | | | | |
| 4 | 7.2 | 1.44 | A | 7.3 | 1.44 | A | 5.6 | 1.38 | A | 5.5 | 1.34 | A |
| 5 | 7.8 | 1.45 | A | 7.4 | 1.44 | A | 5.7 | 1.38 | A | 5.5 | 1.34 | A |

What is claimed is:

1. A developer-carrying member comprising:

a conductive substrate; and a conductive resin coating layer provided on the surface of the conductive substrate;

wherein;

said conductive resin coating layer comprises a resin in which graphite particles stand dispersed, wherein 50% or more of the exposed surface of the conductive resin coating layer is covered by said graphite particles.

2. The developer-carrying member according to claim 1, which is a developer-carrying member used in a developing apparatus in which an electrostatic latent image formed on an image-bearing member is developed with a positively chargeable developer carried on the developer-carrying member to render the electrostatic latent image visible.

3. The developer-carrying member according to claim 1, wherein the degree of uncovering of said graphite particles to the surface of said conductive resin coating layer is from 50% to 98%.

4. The developer-carrying member according to claim 1, wherein said conductive resin coating layer contains conductive particles.

5. The developer-carrying member according to claim 1, wherein said conductive resin coating layer contains conductive particles in an amount of from 1 part by weight to 100 parts by weight based on 100 parts by weight of the resin.

6. The developer-carrying member according to claim 1, wherein said conductive resin coating layer contains said graphite particles in an amount of from 2 parts by weight to 120 parts by weight based on 100 parts by weight of the resin.

7. The developer-carrying member according to claim 1, wherein said conductive resin coating layer contains said graphite particles in an amount of from 4 parts by weight to 60 parts by weight based on 100 parts by weight of the resin.

8. The developer-carrying member according to claim 1, which has been produced by a production process comprising the steps of:

primary treatment to form on the surface of a conductive substrate a conductive resin coating layer comprising a resin in which graphite particles stand dispersed; and secondary treatment to remove a surface portion of the conductive resin coating layer to uncover the graphite particles to the surface of the conductive resin coating layer at a degree of uncovering of 50% or more.

9. The developer-carrying member according to claim 8, wherein in said secondary treatment step the surface portion of the conductive resin coating layer is abraded by subjecting the surface portion of said conductive resin coating layer to polishing.

10. The developer-carrying member according to claim 8, wherein in said secondary treatment step the surface portion of the conductive resin coating layer is removed by subjecting the surface portion of said conductive resin coating layer to wet etching with an etchant to melt away the resin at the surface portion of said conductive resin coating layer.

11. A developer-carrying member comprising:

a conductive substrate; and a conductive resin coating layer provided on the surface of the conductive substrate;

wherein;

said conductive resin coating layer comprises a resin in which molybdenum disulfide particles stand dispersed, wherein 30% or more of the exposed surface of the conductive resin coating layer is covered by said molybdenum disulfide particles.

12. The developer-carrying member according to claim 11, which is a developer-carrying member used in a developing apparatus in which an electrostatic latent image formed on an image-bearing member is developed with a positively chargeable developer carried on the developer-carrying member to render the electrostatic latent image visible.

13. The developer-carrying member according to claim 11, wherein the degree of uncovering of said molybdenum disulfide particles to the surface of said conductive resin coating layer is from 30% to 95%.

14. The developer-carrying member according to claim 11, wherein said conductive resin coating layer contains conductive particles.

15. The developer-carrying member according to claim 11, wherein said conductive resin coating layer contains conductive particles in an amount of from 1 part by weight to 100 parts by weight based on 100 parts by weight of the resin.

16. The developer-carrying member according to claim 11, wherein said conductive resin coating layer contains said molybdenum disulfide particles in an amount of from 2 parts by weight to 120 parts by weight based on 100 parts by weight of the resin.

17. The developer-carrying member according to claim 11, wherein said conductive resin coating layer contains said molybdenum disulfide particles in an amount of from 4 parts by weight to 60 parts by weight based on 100 parts by weight of the resin.

18. The developer-carrying member according to claim 11, which has been produced by a production process comprising the steps of:

primary treatment to form on the surface of a conductive substrate a conductive resin coating layer comprising a resin in which molybdenum disulfide particles stand dispersed; and secondary treatment to remove a surface portion of the conductive resin coating layer to uncover the molybdenum disulfide particles to the surface of the conductive resin coating layer at a degree of uncovering of 30% or more.

19. The developer-carrying member according to claim 18, wherein in said secondary treatment step the surface portion of the conductive resin coating layer is abraded by subjecting the surface portion of said conductive resin coating layer to polishing.

20. The developer-carrying member according to claim 18, wherein in said secondary treatment step the surface portion of the conductive resin coating layer is removed by subjecting the surface portion of said conductive resin coating layer to wet etching with an etchant to melt away the resin at the surface portion of said conductive resin coating layer.

21. A process for producing a developer-carrying member, comprising the steps of:

primary treatment to form on the surface of a conductive substrate a conductive resin coating layer comprising a resin in which graphite particles stand dispersed; and secondary treatment to remove a surface portion of the conductive resin coating layer sufficient to provide that 30% or more of the exposed surface of the conductive resin coating layer is covered by said molybdenum disulfide particles.

22. The process according to claim 21, wherein in said secondary treatment the surface portion of the developer-carrying member is so removed that the degree of uncovering of the graphite particles to the conductive resin coating layer surface comes to be 50% or more, measuring glossiness of the surface of said developer-carrying member as an index.

23. The process according to claim 21, wherein in said secondary treatment the surface portion of the conductive resin coating layer is abraded by subjecting the surface portion of said conductive resin coating layer to polishing.

24. The process according to claim 21, wherein in said secondary treatment step the surface portion of the conductive resin coating layer is removed by subjecting the surface portion of said conductive resin coating layer to wet etching with an etchant to melt away the resin at the surface portion of said conductive resin coating layer.

25. The process according to claim 21, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

26. The process according to claim 21, wherein the degree of uncovering of said graphite particles to the surface of said conductive resin coating layer is from 50% to 98%.

27. The process according to claim 21, wherein said conductive resin coating layer contains conductive particles.

28. The process according to claim 21, wherein said conductive resin coating layer contains conductive particles in an amount of from 1 part by weight to 100 parts by weight based on 100 parts by weight of the resin.

29. The process according to claim 21, wherein said conductive resin coating layer contains said graphite particles in an amount of from 2 parts by weight to 120 parts by weight based on 100 parts by weight of the resin.

30. The process according to claim 21, wherein said conductive resin coating layer contains said graphite particles in an amount of from 4 parts by weight to 60 parts by weight based on 100 parts by weight of the resin.

31. A process for producing a developer-carrying member, comprising the steps of:

primary treatment to form on the surface of a conductive substrate a conductive resin coating layer comprising a resin in which molybdenum disulfide particles stand dispersed; and secondary treatment to remove a surface portion of the conductive resin coating layer sufficient to provide that 30% or more of the exposed surface of the conductive resin coating layer is covered by said molybdenum disulfide particles.

32. The process according to claim 31, wherein in said secondary treatment the surface portion of the developer-carrying member is so removed that the degree of uncovering of the molybdenum disulfide particles to the conductive resin coating layer surface comes to be 30% or more, measuring glossiness of the surface of said developer-carrying member as an index.

33. The process according to claim 31, wherein in said secondary treatment the surface portion of the conductive resin coating layer is abraded by subjecting the surface portion of said conductive resin coating layer to polishing.

34. The process according to claim 31, wherein in said secondary treatment step the surface portion of the conductive resin coating layer is removed by subjecting the surface portion of said conductive resin coating layer to wet etching with an etchant to melt away the resin at the surface portion of said conductive resin coating layer.

35. The process according to claim 31, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

36. The process according to claim 31, wherein the degree of uncovering of said molybdenum disulfide particles to the surface of said conductive resin coating layer is from 30% to 95%.

37. The process according to claim 31, wherein said conductive resin coating layer contains conductive particles.

38. The process according to claim 31, wherein said conductive resin coating layer contains conductive particles in an amount of from 1 part by weight to 100 parts by weight based on 100 parts by weight of the resin.

39. The process according to claim 31, wherein said conductive resin coating layer contains said molybdenum disulfide particles in an amount of from 2 parts by weight to 120 parts by weight based on 100 parts by weight of the resin.

40. The process according to claim 31, wherein said conductive resin coating layer contains said molybdenum disulfide particles in an amount of from 4 parts by weight to 60 parts by weight based on 100 parts by weight of the resin.

41. A developing apparatus comprising:

a positively chargeable one-component developer for developing an electrostatic latent image formed on an image-bearing member; and a developer-carrying member for carrying thereon the positively chargeable one-component developer;

said developer-carrying member comprising a conductive substrate and a conductive resin coating layer provided on the surface of the conductive substrate, wherein;

said conductive resin coating layer comprises a resin in which graphite particles stand dispersed, wherein 50% or more of the exposed surface of the conductive resin coating layer is covered by said graphite particles.

42. The developing apparatus according to claim 41, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

43. The developing apparatus according to claim 41, wherein the degree of uncovering of said graphite particles to the surface of said conductive resin coating layer is from 50% to 98%.

44. The developing apparatus according to claim 41, wherein said conductive resin coating layer contains conductive particles.

45. The developing apparatus according to claim 41, wherein said conductive resin coating layer contains conductive particles in an amount of from 1 part by weight to 100 parts by weight based on 100 parts by weight of the resin.

46. The developing apparatus according to claim 41, wherein said conductive resin coating layer contains said graphite particles in an amount of from 2 parts by weight to 120 parts by weight based on 100 parts by weight of the resin.

47. The developing apparatus according to claim 41, wherein said conductive resin coating layer contains said graphite particles in an amount of from 4 parts by weight to 60 parts by weight based on 100 parts by weight of the resin.

48. The developing apparatus according to claim 41, wherein said developer-carrying member has been produced by a production process comprising the steps of:

primary treatment to form on the surface of a conductive substrate a conductive resin coating layer comprising a resin in which graphite particles stand dispersed; and secondary treatment to remove a surface portion of the conductive resin coating layer to uncover the graphite particles to the surface of the conductive resin coating layer at a degree of uncovering of 50% or more.

49. The developing apparatus according to claim 48, wherein in said secondary treatment step the surface portion of the conductive resin coating layer is abraded by subjecting the surface portion of said conductive resin coating layer to polishing.

50. The developing apparatus according to claim 48, wherein in said secondary treatment step the surface portion of the conductive resin coating layer is removed by subjecting the surface portion of said conductive resin coating layer to wet etching with an etchant to melt away the resin at the surface portion of said conductive resin coating layer.

51. The developing apparatus according to claim 41, wherein said developer-carrying member is so disposed that its surface has a gap to the surface of an electrostatic latent image bearing member.

52. The developing apparatus according to claim 51, which further comprises a developer layer thickness regulation member for regulating the layer thickness of a developer layer coated on the developer-carrying member surface.

53. The developing apparatus according to claim 52, wherein the layer thickness of the developer layer coated on the developer-carrying member surface and regulated by said developer layer thickness regulation member is smaller than the gap between the surface of said developer-carrying member and the surface of said electrostatic latent image bearing member.

54. The developing apparatus according to claim 53, wherein an alternating bias voltage is applied to said developer-carrying member at the time of development.

55. A developing apparatus comprising:

a positively chargeable one-component developer for developing an electrostatic latent image formed on an image-bearing member; and a developer-carrying member for carrying thereon the positively chargeable one-component developer;

said developer-carrying member comprising a conductive substrate and a conductive resin coating layer provided on the surface of the conductive substrate, wherein;

said conductive resin coating layer comprises a resin in which molybdenum disulfide particles stand dispersed, wherein 30% or more of the exposed surface of the conductive resin coating layer is covered by said molybdenum disulfide particles.

56. The developing apparatus according to claim 55, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

57. The developing apparatus according to claim 55, wherein the degree of uncovering of said molybdenum disulfide particles to the surface of said conductive resin coating layer is from 30% to 95%.

58. The developing apparatus according to claim 55, wherein said conductive resin coating layer contains conductive particles.

59. The developing apparatus according to claim 55, wherein said conductive resin coating layer contains conductive particles in an amount of from 1 part by weight to 100 parts by weight based on 100 parts by weight of the resin.

60. The developing apparatus according to claim 55, wherein said conductive resin coating layer contains said molybdenum disulfide particles in an amount of from 2 parts by weight to 120 parts by weight based on 100 parts by weight of the resin.

61. The developing apparatus according to claim 55, wherein said conductive resin coating layer contains said molybdenum disulfide particles in an amount of from 4 parts by weight to 60 parts by weight based on 100 parts by weight of the resin.

62. The developing apparatus according to claim 55, wherein said developer-carrying member has been produced by a production process comprising the steps of;

primary treatment to form on the surface of a conductive substrate a conductive resin coating layer comprising a resin in which molybdenum disulfide particles stand dispersed; and secondary treatment to remove a surface portion of the conductive resin coating layer to uncover the molybdenum disulfide particles to the surface of the conductive resin coating layer at a degree of uncovering of 30% or more.

63. The developing apparatus according to claim 62, wherein in said secondary treatment step the surface portion of the conductive resin coating layer is abraded by subjecting the surface portion of said conductive resin coating layer to polishing.

64. The developing apparatus according to claim 62, wherein in said secondary treatment step the surface portion of the conductive resin coating layer is removed by subjecting the surface portion of said conductive resin coating layer to wet etching with an etchant to melt away the resin at the surface portion of said conductive resin coating layer.

65. The developing apparatus according to claim 55, wherein said developer-carrying member is so disposed that its surface has a gap to the surface of an electrostatic latent image bearing member.

66. The developing apparatus according to claim 65, which further comprises a developer layer thickness regulation member for regulating the layer thickness of a developer layer coated on the developer-carrying member surface.

67. The developing apparatus according to claim 66, wherein the layer thickness of the developer layer coated on the developer-carrying member surface and regulated by said developer layer thickness regulation member is smaller than the gap between the surface of said developer-carrying member and the surface of said electrostatic latent image bearing member.

68. The developing apparatus according to claim 67, wherein an alternating bias voltage is applied to said developer-carrying member at the time of development.

69. An image-forming apparatus comprising:

a developing apparatus having;

a positively chargeable one-component developer for developing an electrostatic latent image formed on an image-bearing member; and a developer-carrying member for carrying thereon the positively chargeable one-component developer;

said developer-carrying member comprising a conductive substrate and a conductive resin coating layer provided on the surface of the conductive substrate, wherein;

said conductive resin coating layer comprises a resin in which graphite particles stand dispersed, wherein 50% or more of the exposed surface of the conductive resin coating layer is covered by said graphite particles.

70. The image-forming apparatus according to claim 69, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

71. The image-forming apparatus according to claim 69, wherein the degree of uncovering of said graphite particles to the surface of said conductive resin coating layer is from 50% to 98%.

72. The image-forming apparatus according to claim 69, wherein said conductive resin coating layer contains conductive particles.

73. The image-forming apparatus according to claim 69, wherein said conductive resin coating layer contains conductive particles in an amount of from 1 part by weight to 100 parts by weight based on 100 parts by weight of the resin.

74. The image-forming apparatus according to claim 69, wherein said conductive resin coating layer contains said graphite particles in an amount of from 2 parts by weight to 120 parts by weight based on 100 parts by weight of the resin.

75. The image-forming apparatus according to claim 69, wherein said conductive resin coating layer contains said graphite particles in an amount of from 4 parts by weight to 60 parts by weight based on 100 parts by weight of the resin.

76. The image-forming apparatus according to claim 69, wherein said developer-carrying member has been produced by a production process comprising the steps of:

primary treatment to form on the surface of a conductive substrate a conductive resin coating layer comprising a resin in which graphite particles stand dispersed; and secondary treatment to remove a surface portion of the conductive resin coating layer to uncover the graphite particles to the surface of the conductive resin coating layer at a degree of uncovering of 50% or more.

77. The image-forming apparatus according to claim 76, wherein in said secondary treatment step the surface portion of the conductive resin coating layer is abraded by subjecting the surface portion of said conductive resin coating layer to polishing.

78. The image-forming apparatus according to claim 76, wherein in said secondary treatment step the surface portion of the conductive resin coating layer is removed by subjecting the surface portion of said conductive resin coating layer to wet etching with an etchant to melt away the resin at the surface portion of said conductive resin coating layer.

79. The image-forming apparatus according to claim 69, wherein in said developing apparatus said developer-carrying member is so disposed that its surface has a gap to the surface of an electrostatic latent image bearing member.

80. The image-forming apparatus according to claim 79, wherein said developing apparatus further comprises a developer layer thickness regulation member for regulating the layer thickness of a developer layer coated on the developer-carrying member surface.

81. The image-forming apparatus according to claim 80, wherein the layer thickness of the developer layer coated on the developer-carrying member surface and regulated by said developer layer thickness regulation member is smaller than the gap between the surface of said developer-carrying member and the surface of said electrostatic latent image bearing member.

82. The image-forming apparatus according to claim 81, wherein an alternating bias voltage is applied to said developer-carrying member at the time of development.

83. An image-forming apparatus comprising;

a developing apparatus having;

a positively chargeable one-component developer for developing an electrostatic latent image formed on an image-bearing member; and a developer-carrying member for carrying thereon the positively chargeable one-component developer;

said developer-carrying member comprising a conductive substrate and a conductive resin coating layer provided on the surface of the conductive substrate, wherein;

said conductive resin coating layer comprises a resin in which molybdenum disulfide particles stand dispersed, wherein 30% or more of the exposed surface of the conductive resin coating layer is covered by said molybdenum disulfide particles.

84. The image-forming apparatus according to claim 83, wherein said developer-carrying member is a developer-carrying member used in a developing apparatus in which an electrostatic latent image formed on an image-bearing member is developed with a positively chargeable developer carried on the developer-carrying member to render the electrostatic latent image visible.

85. The image-forming apparatus according to claim 83, wherein the degree of uncovering of said molybdenum disulfide particles to the surface of said conductive resin coating layer is from 30% to 95%.

86. The image-forming apparatus according to claim 83, wherein said conductive resin coating layer contains conductive particles.

87. The image-forming apparatus according to claim 83, wherein said conductive resin coating layer contains conductive particles in an amount of from 1 part by weight to 100 parts by weight based on 100 parts by weight of the resin.

88. The image-forming apparatus according to claim 83, wherein said conductive resin coating layer contains said molybdenum disulfide particles in an amount of from 2 parts by weight to 120 parts by weight based on 100 parts by weight of the resin.

89. The image-forming apparatus according to claim 83, wherein said conductive resin coating layer contains said molybdenum disulfide particles in an amount of from 4 parts by weight to 60 parts by weight based on 100 parts by weight of the resin.

90. The image-forming apparatus according to claim 83, wherein said developer-carrying member has been produced by a production process comprising the steps of:

primary treatment to form on the surface of a conductive substrate a conductive resin coating layer comprising a resin in which molybdenum disulfide particles stand dispersed; and secondary treatment to remove a surface portion of the conductive resin coating layer to uncover the molybdenum disulfide particles to the surface of the conductive resin coating layer at a degree of uncovering of 30% or more.

91. The image-forming apparatus according to claim 90, wherein in said secondary treatment step the surface portion of the conductive resin coating layer is abraded by subjecting the surface portion of said conductive resin coating layer to polishing.

92. The image-forming apparatus according to claim 90, wherein in said secondary treatment step the surface portion of the conductive resin coating layer is removed by subjecting the surface portion of said conductive resin coating layer to wet etching with an etchant to melt away the resin at the surface portion of said conductive resin coating layer.

93. The image-forming apparatus according to claim 83, wherein in said developing apparatus said developer-carrying member is so disposed that its surface has a gap to the surface of an electrostatic latent image bearing member.

94. The image-forming apparatus according to claim 93, wherein said developing apparatus further comprises a developer layer thickness regulation member for regulating the layer thickness of a developer layer coated on the developer-carrying member surface.

95. The image-forming apparatus according to claim 94, wherein the layer thickness of the developer layer coated on the developer-carrying member surface and regulated by said developer layer thickness regulation member is smaller than the gap between the surface of said developer-carrying member and the surface of said electrostatic latent image bearing member.

96. The image-forming apparatus according to claim 95, wherein an alternating bias voltage is applied to said developer-carrying member at the time of development.

* * * * *

UNITED STATES PATENT AND TRADEMARK OFFICE

CERTIFICATE OF CORRECTION

PATENT NO. : 6,430,384 B2
DATED : August 6, 2002
INVENTOR(S) : Masayuki Hama et al.

It is certified that error appears in the above-identified patent and that said Letters Patent is hereby corrected as shown below:

Column 1,
Line 41, "used" should read -- use --.

Column 10,
Exemplary Compound 6, " 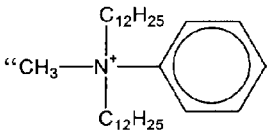 " should read -- 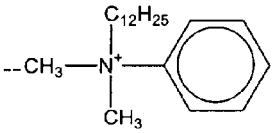 --.

Column 15,
Line 62, "show" should read -- shown --.

Column 21,
Line 26, "wherein;" should read -- wherein, --.

Column 22,
Line 36, "wherein;" should read -- wherein, --.

Column 25,
Line 5, "wherein;" should read -- wherein, --.

Column 26,
Line 15, "wherein;" should read -- wherein, --;
Line 52, "of;" should read -- of: --.

Column 27,
Line 26, "having;" should read -- having, --;
Line 34, "wherein;" should read -- wherein, --.

UNITED STATES PATENT AND TRADEMARK OFFICE

CERTIFICATE OF CORRECTION

PATENT NO. : 6,430,384 B2
DATED : August 6, 2002
INVENTOR(S) : Masayuki Hama et al.

It is certified that error appears in the above-identified patent and that said Letters Patent is hereby corrected as shown below:

Column 28,
Line 41, "comprising;" should read -- comprising: --;
Line 51, "wherein;" should read -- wherein, --.

Signed and Sealed this

Twenty-fifth Day of February, 2003

JAMES E. ROGAN
*Director of the United States Patent and Trademark Office*